US007909067B2

(12) United States Patent
Offersen et al.

(10) Patent No.: US 7,909,067 B2
(45) Date of Patent: Mar. 22, 2011

(54) METHOD, AN APPARATUS AND A MEANS FOR MAKING A REINFORCEMENT MESH

(75) Inventors: Kurt Offersen, Ørbæk (DK); Claus Brask, Ørbæk (DK)

(73) Assignee: SpinMaster ApS, Orbaek (DK)

( * ) Notice: Subject to any disclaimer, the term of this patent is extended or adjusted under 35 U.S.C. 154(b) by 554 days.

(21) Appl. No.: 11/815,998

(22) PCT Filed: Feb. 17, 2006

(86) PCT No.: PCT/DK2006/000099

§ 371 (c)(1),
(2), (4) Date: Oct. 19, 2007

(87) PCT Pub. No.: WO2006/097100

PCT Pub. Date: Sep. 21, 2006

(65) Prior Publication Data

US 2008/0276564 A1 Nov. 13, 2008

(30) Foreign Application Priority Data

Feb. 17, 2005 (DK) ..... 2005 00247
Mar. 31, 2005 (DK) ..... 2005 00081 U

(51) Int. Cl.
*B21F 27/06* (2006.01)
*B21F 27/02* (2006.01)
*B21F 29/00* (2006.01)

(52) U.S. Cl. ..... 140/5; 140/7; 140/39; 140/45

(58) Field of Classification Search ..... 72/7, 17, 72/107, 112; 140/7, 17, 107, 112, 5, 30, 140/36, 40, 39, 45, 118, 149; 245/11
See application file for complete search history.

(56) References Cited

U.S. PATENT DOCUMENTS 2,223,317 A * 11/1940 Ewing ..... 140/30
7,493,924 B2 * 2/2009 Garcia et al. ..... 140/92.7

* cited by examiner

*Primary Examiner* — Dana Ross
*Assistant Examiner* — Mohammad Yusuf
(74) *Attorney, Agent, or Firm* — William J. Sapone; Coleman Sudol Sapone P.C.

(57) ABSTRACT

Production of a reinforcement mesh comprising reinforcement bars (3), which are tied together by means of twisted wires (1, 2), may take place according to the invention by a method wherein two wires (1, 2) are rolled up on their respective wire coils (4, 5), which are mounted opposite each other on a rotatable shaft (12), and wherein each of the wires is guided by a wire guide element (6) downwards in a direction toward the common twisting point of the wires (1, 2). Meshes of surface-treated, coated, wires and bars may be made in this manner, there being no external impact that can damage the surface.

6 Claims, 2 Drawing Sheets

METHOD, AN APPARATUS AND A MEANS FOR MAKING A REINFORCEMENT MESH

THE PRIOR ART

Figure 1:
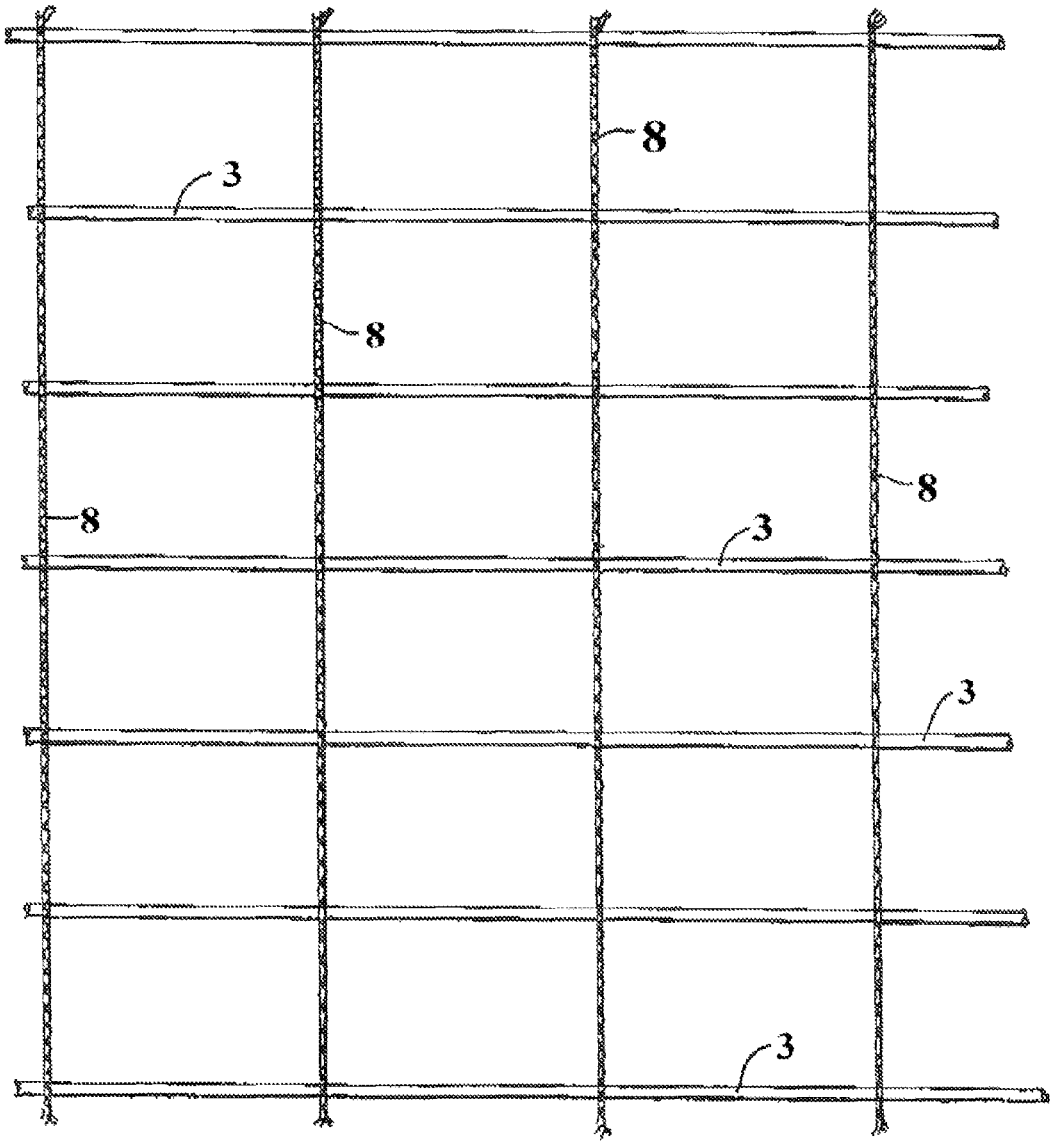

The invention relates to a method, an apparatus and a means for making a reinforcement mesh, in particular for use in concrete structures, said mesh comprising reinforcement bars which are held together by means of a flexible holding means so as to form a mesh comprising held bars at a desired mutual distance, said holding means being formed by two wires which extend respectively above and below each individual reinforcement bar, and which, when being twisted, are clamped around the individual bars.

Reinforcement work constitutes a considerable factor in connection with reinforced concrete work.

In an attempt at reducing the costs in connection with reinforcement work it is known to make reinforcement meshes which may partly be roiled up to facilitate storage and transport and may partly be mounted in a relatively simple manner.

This mesh may be made by means of mounted holding means for the individual bars so that these may be attached relatively easily to the holding means at the desired point, or in that the individual bars are secured to a carrying band.

Then, the assembled reinforcement may be arranged at the desired point.

However, all previous attempts at simplifying the reinforcement work suffer from various drawbacks.

Where joining is concerned, this takes place by welding which involves damage to the surface of the bars. This is a drawback when the bars are surface treated with corrosion protection, which is destroyed thereby, and, in addition, the bars are weakened at the points concerned.

Where bands are used as a holding means, these must normally be tack welded, which is both cumbersome and time-consuming.

Japanese published application No. 2001 182220 discloses a reinforcement mesh consisting of reinforcement bars which are held together by means of twisted wires.

This known structure describes a mesh which is held together by twisted wires, which wires, however, are wound around "loose" reinforcement bars and thereby provide no certainty of the tolerance, constancy of size and strength of the finished reinforcement mesh.

THE OBJECT OF THE INVENTION

It is the object of the invention to remedy these defects and drawbacks, and this is achieved by a method and an apparatus, wherein the wires are roiled up on their respective coils which are mounted diametrically opposite each other on a rotatable shaft and have a wire guide, secured to the shaft, with a wire guide element at each coil for the formation of a twist of the wires by rotation of the shaft, said twist comprising a twisting around each reinforcement bar which is kept in the position.

This method ensures a gentle supply, friction and guidance of the wires so that the individual reinforcement bars may be inserted between the wires before they are twisted, and also a precise positioning of the individual bars to ensure their quite precise position in the mesh.

Through the use of generally known control technology, this insertion and attachment of the bars and the subsequent supply of wires and their twisting are controlled such that meshes may be produced in a rapid, simple and stable manner according to the method.

When the desired length of the twist has been achieved, a new reinforcement bar may be inserted and held between the separated wires, and the process is repeated until the desired mesh length has been achieved.

When the wires are allowed to extend at an oblique angle toward the twisting point, it is possible to feed the wires in a very gentle manner, whereby optional surface treatment remains intact during the feeding and the twisting. This ensures that the corrosion protection of the mesh is optimum.

When the mesh is moved away from the twisting point in step with the increase in the length of the twist, it is possible currently to wound the mesh to form a mesh roll.

Finally, it is expedient to use coated wire and coated reinforcement bars, since this ensures the best possible corrosion protection of the reinforcement mesh before and after the embedment.

THE DRAWING

Figure 2:
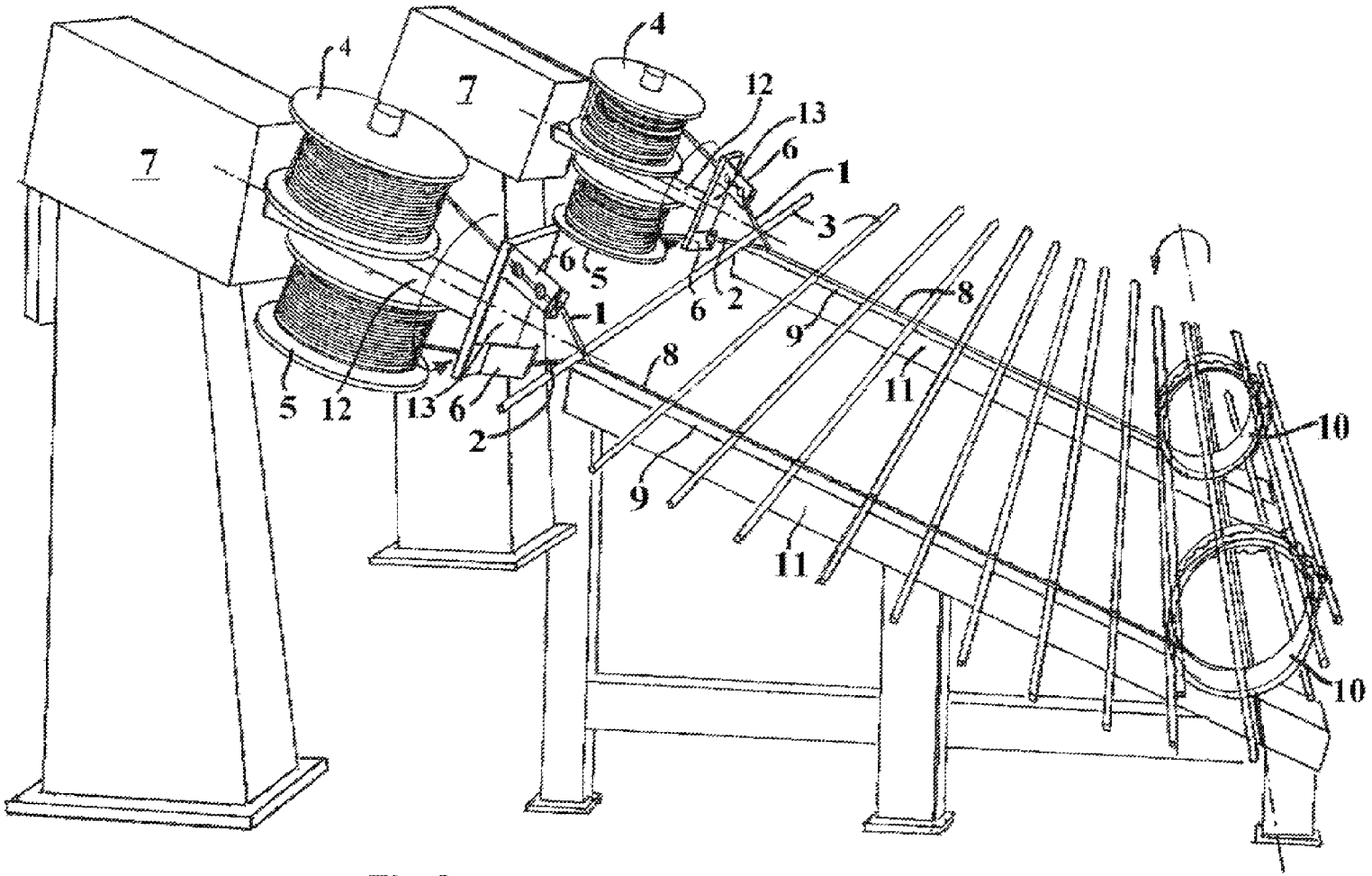

An example of an apparatus for performing the method will be described more fully below with reference to the drawing, in which FIG. 1 shows a section of a finished reinforcement mesh, FIG. 2 shows a section of an apparatus for making a reinforcement mesh.

DESCRIPTION OF AN EXEMPLARY EMBODIMENT

The object of the invention is to make a reinforcement mesh, and as an example of this, the example shown in FIG. 1 will be described.

The reinforcement bars 3 are held at a predetermined mutual distance.

As will appear from FIG. 1, the binding 8 is composed of two wires which, when being twisted, form) the spacer 8 between adjacent bars 3, and by allowing the wire to extend respectively above and below the individual bars the wires are clamped around these and hold them reliably and gently.

When heavy steel wire is used for the wires, the holding means and the spacer 8 may constitute a factor in the dimensioning of the reinforcement, which will both simplify it and reduce its costs.

An example of a system for the making of a reinforcement mesh according to the invention is shown in FIGS. 2 and 3.

The system comprises two or more sets of wire coils 4, 5 positioned opposite each other on a rotary shaft 12. The rotary shaft 12 is driven by a drive unit 7, as indicated in the drawing. A wire guide 13 with a wire guide element 6 opposite each wire coil 4 and 5 is mounted at the end of the shaft 12.

The wire guides 13 and the wire guide element 6 are configured such that the wires 1 and 2 are conveyed in a direction toward the twisting point, and at the same time they form an opening into which a reinforcement bar 3 may be inserted.

When the reinforcement bar 3 is in position, as indicated in the drawing FIG. 2 the rotation of the shafts 12 is started, thereby initiating the twisting. The wire guide element 6 is configured such that a suitable friction is achieved for a suitably tight twisting and thereby holding of the bars 3 in the twist 8.

The bar 3 is moved at the same time as the twisting further forwards by the holding means 16, simultaneously with the next bar 3 being inserted and held, in that the wires are twisted. The motor 17 moves the holding means 16.

The procedure is continued in that the mesh slides down over ramps 9, while a rolling-up drum 10 rolls up the mesh as the twist is wound off to form the reinforcement mesh, which comprises bars 3 with the predetermined mutual distance and length.

Meshes of any desired dimension may be made by means of this system to perform the individual reinforcement tasks.

As the mesh is rolled up in the making, it is easy to transport and place in position in the reinforcement.

Surface-treated bars 3 and wires 1 and 2, which are not damaged in the making, may advantageously be used, thereby ensuring the optimum durability and strength.

The invention claimed is:

1. A method for making a reinforcement mesh composed of a plurality of reinforcement bars held at a desired mutual distance from each other for use in concrete structures, said method comprising:

providing the plurality of reinforcement bars;

placing two wires rolled up on respective coils mounted diametrically opposite from each other on opposite sides of a rotatable shaft and providing a wire guide having a pair of wire guide elements for guiding each of the two wires in a direction towards a twisting point, the space between the wires leading to the twisting point forming an opening;

inserting a reinforcement bar into the opening with a first wire above the reinforcement bar and a second wire positioned below the reinforcement bar;

rotating the shaft such that the wire guide elements twist the two wires and at the same time moving the reinforcement bar in a direction away from the twisting point a predetermined distance, thereby twisting the two wires around the individual reinforcement bar to clamp and hold the reinforcement bar in place;

the moving of the reinforcement bar away from the twisting point clearing the opening for inserting another of the plurality of reinforcement bars into the opening, and, repeating the above steps for forming a mesh composed of a plurality of reinforcement bars mutually spaced apart at the predetermined distance and held by the twisted wires.

2. The method according to claim 1, wherein the moving of the re-inforcement bar and the twist formed by the wires away from the twisting point is performed step wise with the twisting.

3. The method of claim 1 further comprising providing the two wires and the reinforcement bars with a protective coating.

4. An apparatus for making a reinforcement mesh composed of a plurality of reinforcement bars held at a desired mutual distance from each other for use in concrete structures, said apparatus comprising:

a rotatable shaft supporting at least two respective coils mounted on opposite sides thereof, diametrically opposite from each other, each coil holding a wire, and a wire guide, secured to the rotatable shaft and supporting two wire guide elements for guiding each of the two wires in a direction towards a twisting point, the space between the wires leading to the twisting point forming an opening for receiving a reinforcement bar therein;

means for extending the reinforcement bar between the two wires respectively located above and below the reinforcement bar, means for rotating the shaft for twisting the two wires using the wire guide elements for clamping the two wires around the reinforcement bar to hold each reinforcement bar in place, means for moving the bar in a direction away from the twisting point a predetermined distance as the wires are twisted around the bar, thereby freeing the opening for receiving another reinforcement bar spaced away from the wire clamped bar the predetermined distance.

5. The apparatus of claim 4 wherein the wire guide elements extend at an oblique angle facing toward the twisting point for uniformly positioning the wires during twisting.

6. The apparatus of claim 4 wherein the two wires and the reinforcement bars have a protective coating.

* * * * *